US008608411B2

(12) United States Patent
Biserna

(10) Patent No.: US 8,608,411 B2
(45) Date of Patent: Dec. 17, 2013

(54) DEVICE FOR CONSOLIDATING SOILS BY MEANS OF MECHANICAL MIXING AND INJECTION OF CONSOLIDATING FLUIDS

(75) Inventor: Ezio Biserna, Longiano (IT)

(73) Assignee: Soilmec S.p.A., Cesena (FC) (IT)

( * ) Notice: Subject to any disclaimer, the term of this patent is extended or adjusted under 35 U.S.C. 154(b) by 114 days.

(21) Appl. No.: 13/001,584

(22) PCT Filed: Jun. 8, 2009

(86) PCT No.: PCT/EP2009/004101
§ 371 (c)(1),
(2), (4) Date: Mar. 18, 2011

(87) PCT Pub. No.: WO2009/156056
PCT Pub. Date: Dec. 30, 2009

(65) Prior Publication Data

US 2011/0188947 A1 Aug. 4, 2011

(30) Foreign Application Priority Data

Jun. 27, 2008 (IT) ..... TO2008A0503

(51) Int. Cl.
*E02D 3/12* (2006.01)

(52) U.S. Cl.
USPC ..... 405/269; 175/267; 175/269

(58) Field of Classification Search
USPC ..... 405/269, 266, 263; 175/267, 269
See application file for complete search history.

(56) References Cited

U.S. PATENT DOCUMENTS

| | | | | | |
|---|---|---|---|---|---|
| 2,679,383 | A * | 5/1954 | Garrison | 175/269 |
| 3,757,876 | A * | 9/1973 | Pereau | 175/267 |
| 3,757,877 | A * | 9/1973 | Leathers | 175/269 |
| 3,786,641 | A * | 1/1974 | Turzillo | 405/269 |
| 5,018,580 | A * | 5/1991 | Skipper | 175/269 |
| 5,503,501 | A * | 4/1996 | Kunito | 405/269 |
| 5,853,054 | A * | 12/1998 | McGarian et al. | 175/267 |
| 6,668,949 | B1 * | 12/2003 | Rives | 175/269 |
| 6,685,398 | B1 * | 2/2004 | Gunther | 405/269 |
| 7,195,080 | B2 | 3/2007 | De Luca | |
| 2003/0146023 | A1 * | 8/2003 | Pia | 175/269 |
| 2008/0128175 | A1 * | 6/2008 | Radford et al. | 175/269 |

FOREIGN PATENT DOCUMENTS

| | | |
|---|---|---|
| DE | 37 28 270 | 1/1989 |
| EP | 1 400 633 | 3/2004 |
| JP | 59-10610 | 1/1984 |
| WO | WO 93/02257 | 2/1993 |

* cited by examiner

*Primary Examiner* — Frederick L Lagman
(74) *Attorney, Agent, or Firm* — Merchant & Gould P.C.

(57) ABSTRACT

Device (1) for consolidating soils by mechanical mixing and injection of consolidating fluids is designed to be connected to one or more drilling rods and to carry out operations of drilling and mixing. The device has a main body (10), one or more blades (30) (30') (30"), which are mobile with respect to the body (10) and are constrained by cams (22) to a central structure (20) internal to the body (10). The device (1) has channels for the flow of fluids (40), which are connected in a liquid-tight way to at least one sprayer; a relative motion is generated between the central structure (20) and the external body (10) as a function of the pressure of a liquid introduced into the channels for the flow of fluids (40), which brings about opening of the blades (30) (30') (30").

13 Claims, 6 Drawing Sheets

DEVICE FOR CONSOLIDATING SOILS BY MEANS OF MECHANICAL MIXING AND INJECTION OF CONSOLIDATING FLUIDS

This application is a National Stage Application of PCT/EP2009/004101, filed 8 Jun. 2009, which claims benefit of Serial No. TO 2008 A 000503, filed 27 Jun. 2008 in Italy and which applications are incorporated herein by reference. To the extent appropriate, a claim of priority is made to each of the above disclosed applications.

BACKGROUND OF THE INVENTION

The present invention relates to the field of deep drilling; in detail, it regards a device for consolidating soils by means of mechanical mixing and injection of consolidating fluids.

The consolidation of soils envisages the drilling of a hole using a drilling device. During the drilling step, or at the end thereof operations are carried out, designed to increase the characteristics of solidity of an area of soil corresponding substantially to the hole or to areas adjacent thereto.

It is known that the operations of consolidation can use the technologies described in detail hereinafter.

A first technology is the so-called "mechanical dry mixing", which is frequently used for soils in which a fair amount of water is present; the use of this technique envisages insertion of cement in powder form in the soil, exploiting, for example, air compressed at pressures that typically do not exceed 30 bar and a mixing tool equipped with rotating blades fixed with respect to the battery of drilling rods.

A second technique is the so-called "low-pressure wet-mixing", where the consolidation is provided via a jet of fluid made up of a mix of water and concrete (typically known as "grout"). Once again the jet of fluid is characterized by a low pressure (up to a maximum of approximately 40-50 bar) through a tool equipped with blades that are able to mix the soil with the above-mentioned fluid.

A third technique is finally the so-called "high-pressure mechanical wet-mixing".

With this third technique, the treatment for consolidating soil is performed by means of an injection of a jet of high-pressure (typically approximately 100-400 bar) grout coming out of the barrel of a drilling and injection tool equipped with mixing blades (typically in a radial position).

In this way, a minimum diameter of the consolidated area is guaranteed by the presence of the mixing blades (and for this reason the term "mechanical minimum" is used) and a maximum diameter thereof is guaranteed by the pressure of the consolidation fluid. In detail, in fact, the consolidation fluid could also come to operate on areas of soil not reached by the extent of the mixing blades of the drilling and injection drilling tool.

With particular reference to the third and last technique described, the mixing of the soil can occur during the drilling (downwards) or else at the end of the drilling (upwards) or in both direction according to the type of soil to be treated.

For particular requirements of design (for example, in the case where earth removal operations are envisaged after the foundations of a building have laid or the necessary treatments of the soil have carried out) it may be required for mechanical mixing to be performed only in a portion of soil localized at a certain depth. In this case, in the sector, the term "idle traverse" is used, which describes the procedure through which the drilling and mixing tools, which are equipped with radially set extensible blades, pass from the plane of site to a height of treatment, remaining with the blades closed in such a way as to guarantee a minimum drilling diameter. Said solution enables drilling to be speeded up and rendered more economically advantageous.

There exist tools that are able to execute an initial drilling of contained dimensions and that, when a desired depth is reached, via opening-out of some mechanical components resembling cutters, referred to as "mixing blades", carry out a drilling operation or simply mixing of the soil with an injected consolidating fluid, on a diameter much greater than that of the lower depth.

The mixing of the soil is conveniently carried out downwards in the case of easily worked soils; instead, in the presence of "difficult" soils, mixing is preferably carried out upwards, after prior execution, during the initial step of descent, of an operation of injection of even different fluids (a step technically referred to as "pre-cut") in order to lighten the soil and prepare it for the subsequent mixing.

As regards the drilling, cutting and mixing devices, multiple documents are known in the prior art.

For instance, the document No. U.S. Pat. No. 7,195,080 teaches how to solve the problem inherent in the uniqueness of the drilling diameter that can be provided by cutting means (cutters) in the working configuration. The document No. U.S. Pat. No. 7,195,080 moreover teaches how to render the cutters more rigid through blocking means that reduce the vibrations thereof during operation.

In detail, the document No. U.S. Pat. No. 7,195,080, shows a tool for widening a bore hole during a step of descent in depth, which can exploit, for the movement of radial opening of its cutting means (cutters):

- hydraulic energy, through insertion of a linear actuator (jack) connected to a position indicator (indexer) that enables modulation of the opening of the aforesaid blades so as to obtain variability in the drilling diameter;
- other forms of energy, such as for example electrical energy, via provision of an electric motor and/or other simple mechanical devices.

In detail, the hydraulic energy is supplied either via dedicated fluid or using the same fluid used for excavation (bentonite). This fluid actuates a jack that displaces axially a body, which opens the cutters out by levering on a plurality of fulcra. Following upon entrance of the pressurized fluid, blocking means are pushed against the cutters. Once the desired depth has been reached, at the end of the drilling operation the delivery of the dedicated fluid or the drilling fluid (bentonite) is interrupted so that the blocking means are free to move, with consequent release of the cutters, which can close again automatically until they are brought into the initial position.

The technique described by the preceding document does, however, present some disadvantages. In fact, with this technique it is not possible to act with the drilling fluid (bentonite) during the drilling step, keeping the cutters closed. Furthermore, the document does not teach the possibility of injecting consolidating fluid different from the drilling fluid (bentonite). Finally, according to the known art represented by the document No. U.S. Pat. No. 7,195,080, the drilling head must necessarily present a passage or mechanical means purposely dedicated to the system of movement of the blades in the case where these are moved by mechanical and electrical means. In detail moreover, the movement of the blades via electrical means can be decidedly inconvenient and delicate, given the working environment.

Not of least importance, the U.S. document does not teach how to make a head that is effective and will enable consolidation both working downwards and working upwards.

SUMMARY OF THE INVENTION

The purpose of the present invention is to provide a device for consolidating soils by means of mechanical mixing and injection of consolidating fluids that will be free from the drawbacks described above.

According to the present invention, a device for consolidating soils is provided by means of mechanical mixing and injection of consolidating fluids, as claimed in claim 1.

According to the present invention, a device for consolidating soils is provided by means of mechanical mixing and injection of consolidating fluids.

BRIEF DESCRIPTION OF THE DRAWINGS

The invention will now be described with reference to the annexed drawings, which illustrate a non-limiting example of embodiment thereof, wherein.

DETAILED DESCRIPTION OF THE PREFERRED EMBODIMENT(S)

Figure 1:
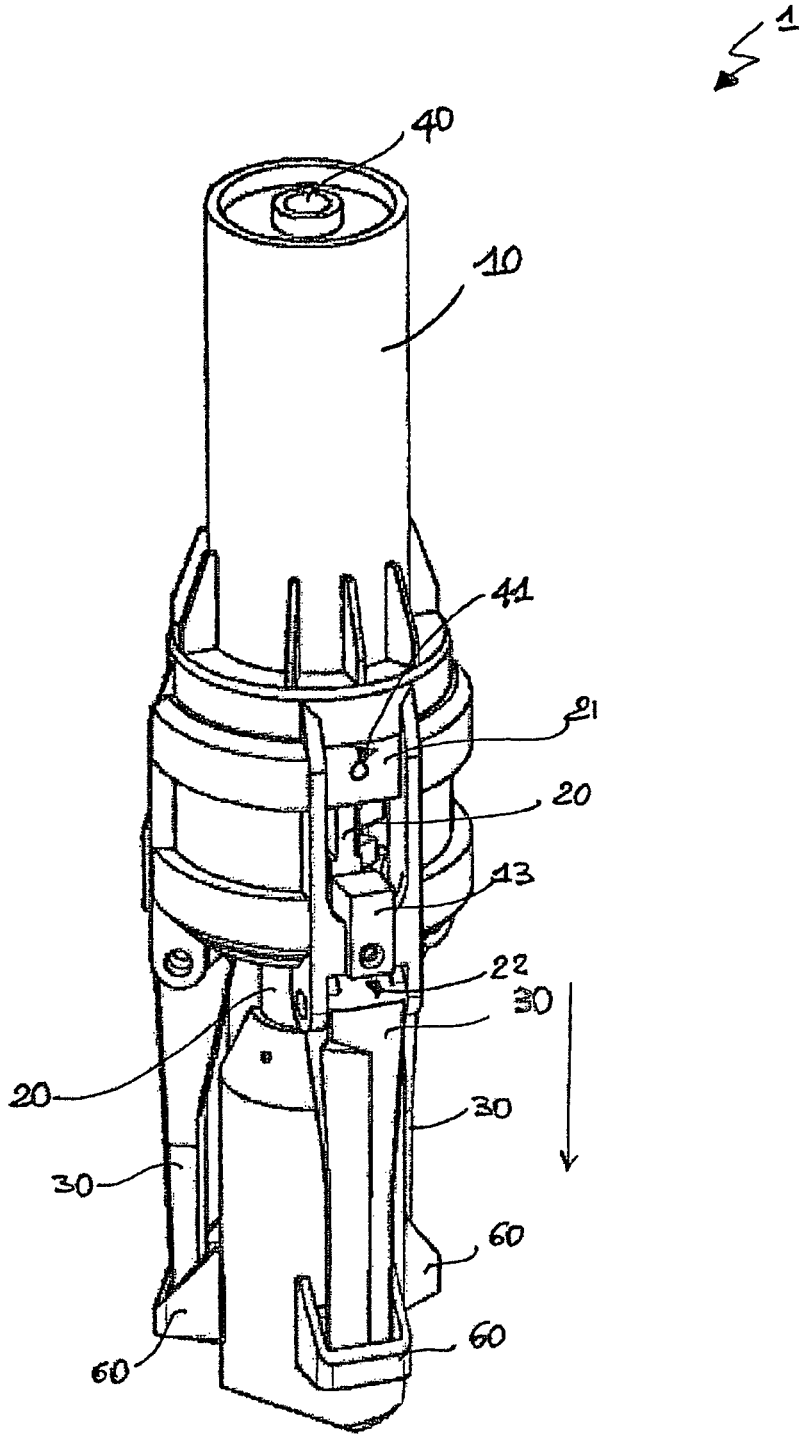
FIG. 1 illustrates a first three-dimensional view of a device for consolidating soils, by means of mechanical mixing and injection of consolidating fluids, that is equipped with blades, which are in the closed condition.

With reference to FIG. 1, designated as a whole by 1 is a device for consolidating soils by means of mechanical mixing and injection of consolidating fluids. The device comprises a main body 10 fixed in use to a battery of drilling rods (not represented) and with which it is possible to carry out the introduction of fluids into the bore hole. Said fluids are typically made to flow within the drilling rods.

The device 1, which during use typically turns on itself, moreover has a plurality of mobile drilling and/or mixing blades 30, which are set along the body of the device and have a first position of use, in which they are substantially set in a direction of maximum extension of the device 1, and a second position of use, in which they extend beyond the volume substantially identified by the body 10 of the device 1.

Figure 2:
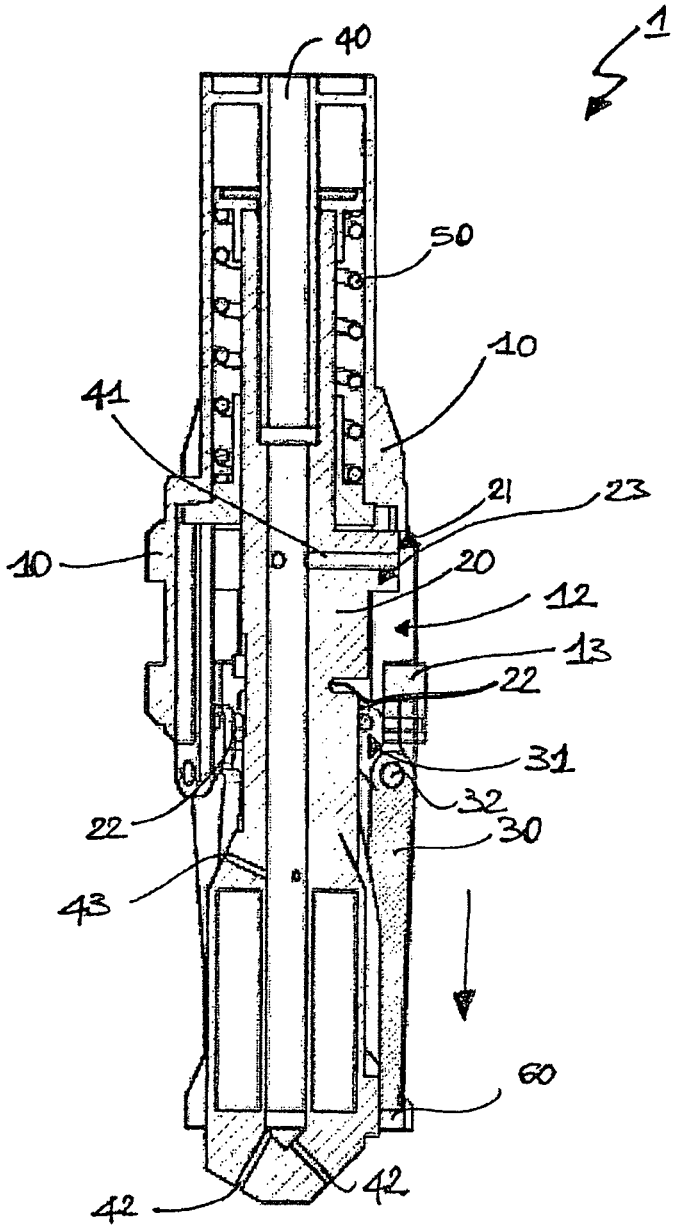
FIG. 2 illustrates a cross section of the device of FIG. 1.

As illustrated in FIG. 2, the device 1 moreover comprises inside it an internal structure 20, axially guided within the body 10, having one or more lateral regions 21, which are designed to slide in one or more guides 12 of the body 10.

In detail, the internal structure 20 can thus slide with respect to the body 10 and receive the rotating drilling torque.

The sliding of the internal structure 20 with respect to the body 10 in the direction indicated by the arrow causes opening of a plurality of blades 30, hinged on the body 10, which in this way extend outwards from the device 1.

In detail, said movement is made possible by a plurality of cams 22, provided on a purposely designed support of the internal structure 20, which engage on a respective pin 31 fixed with respect to the corresponding blade 30.

The device 1 moreover has an internal conduit 40 for the passage of fluids, which is designed to be connected (by means of known techniques) to the drilling rods in such a way as to guarantee fluid tightness. The internal conduit 40, which is fixed with respect to the internal structure 20, has first terminations 41, 43 and, respectively, second terminations 42 that face the outer surface of the device 1; in greater detail, the first terminations 41, 43 are oriented in a lateral direction with respect to the orientation of the internal conduit 20 and are respectively positioned in a top area and in a bottom area with respect to the blades 30; the terminations 41, 43 can be occluded according to the operating needs.

The second terminations 42, instead, direct a flow of fluid downwards with inclinations that can vary with respect to a drilling direction (for example, but not limitedly, at 45°). According to the preferred embodiment of the device 1, said second terminations 42 are positioned at the bottom end of the device 1 itself.

Finally, the device 1 is equipped with a contrast spring 50, constrained between the main body 10 and the internal structure 20 in such a way as to have a resting position, in which the internal structure 20 is retracted upwards, and an extended position, in which the internal structure 20 is kept down, and consequently opening-out of the plurality of blades 30 is brought about. The force of action of the contrast spring 50 can be adjusted.

To aid maintenance of the blades 30 in a closed position (first position of use), the device 1 is finally equipped with a plurality of pockets 60, set radially along the circumference substantially delineated by the internal structure 20, one pocket for each blade 30, which create a mechanical contrast at a distance from the ends of the blades 30 hinged to them.

The pockets 60 are open downwards in such a way as to facilitate exit of any material that may accumulate inside them during the step or steps of drilling and mixing.

When the contrast spring 50 causes the blades 30 to be kept in the first position of use (i.e., closed), the pockets 60 enable fixing of the blades 30; in fact, the pockets 60 are set on the internal structure 20 in such a way as to be at least partially superposed on the blades 30. Instead, when there is present a force sufficient to compress the contrast spring 50 and the central structure 20 extends downwards (i.e., outside the body 10), the pockets 60 release one end of the blades 30, which can thus extend.

The travel of the central structure 20 is in any case such that, upon complete closing of the blades 30, there is a certain play that ensures that the pockets 60 come to set themselves at least partially on top of the blades 30 only when they are completely closed. In other words, the travel of the central structure 20 comprises a first stretch of idle extension, where the blades 30 move parallel to the pockets, so disengaging therefrom, and a second stretch, in which the aforesaid blades 30 open outwards.

A limitation to the opening of the blades 30 is represented by a plurality of mechanical contrast elements 23. The mechanical contrast elements 23 are arranged in a radial position on the central structure 20 and, by coming to bear upon arrests 13 that form part of the body 10 and are positioned above the blades 30, determine the maximum diameter of the circumference substantially described by the blades 30 during rotation. Said arrests 13, which can be dismantled and interchanged, have a shape such as to enable various displacements of the central structure 20 with respect to the body 10 and consequently obtain a plurality of diameters of treatment of the soil.

As an alternative to the embodiment described and represented so far, further embodiments of the device 1 can be used that envisage, instead of the spring, other means for countering the force of the fluid, such as for example chambers with pressurized gas, or else electric or magnetic hydraulic compensators.

In use, during descent of the device 1, a drilling fluid at low pressure (to around 40-50 bar), such as for example air, water, bentonite, or grout, is introduced into the bore hole via the internal conduit 40.

During the drilling step, i.e., working down, the device 1 can proceed with the blades 30 in the first position of use, in which they are set substantially parallel to the direction of maximum extension of the device 1.

The introduction of a low-pressure fluid within the internal conduit 40 generates a force acting in a direction substantially parallel to the drilling direction, which acts on the internal structure 20, which, however, is not able to cause opening of the plurality of blades 30. In fact, said force is countered by an opposing force that is at least equal in modulus, exerted by the contrast spring 50.

Clearly, during dry working, i.e., proceeding with drilling without using any fluid, the blades 30 remain even so in the first position of use.

Instead, when the depth is reached at which it is necessary to carry out the treatment of mechanical mixing and widening of the bore hole, a mixing fluid is introduced within the internal conduit 40 at a pressure such as to enable the force exerted by the contrast spring 50 to be overcome and, consequently, to enable the blades 30 to open out.

In detail, the mixing fluid may be cement, grout, resin, or other consolidating chemical mixtures.

Clearly, the forces involved so far described do not merely take into account the force of retention of the contrast spring 50; in particular, the force necessary to enable opening of the blades 30 must be higher than that of the spring, the forces of friction, the force for opening the blades and in general all the other forces that may intervene during effective operation of the device.

Clearly, the maximum drilling diameter corresponds to the one identified by the blades 30 after a rotation through 90° with respect to the first position of use.

Figure 3:
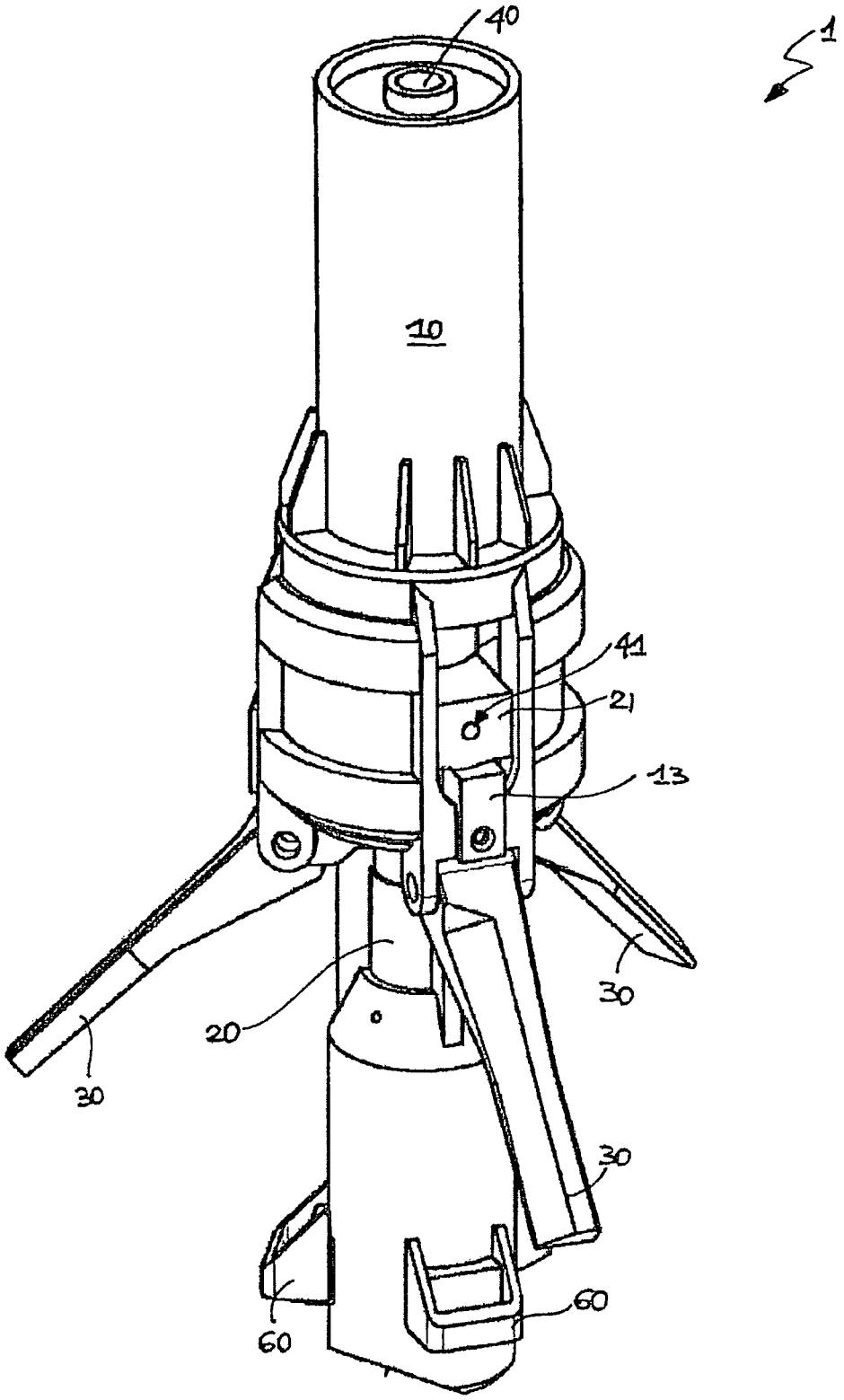
FIG. 3 illustrates a second three-dimensional view of the device of FIG. 1 with the blades open.
Figure 4:
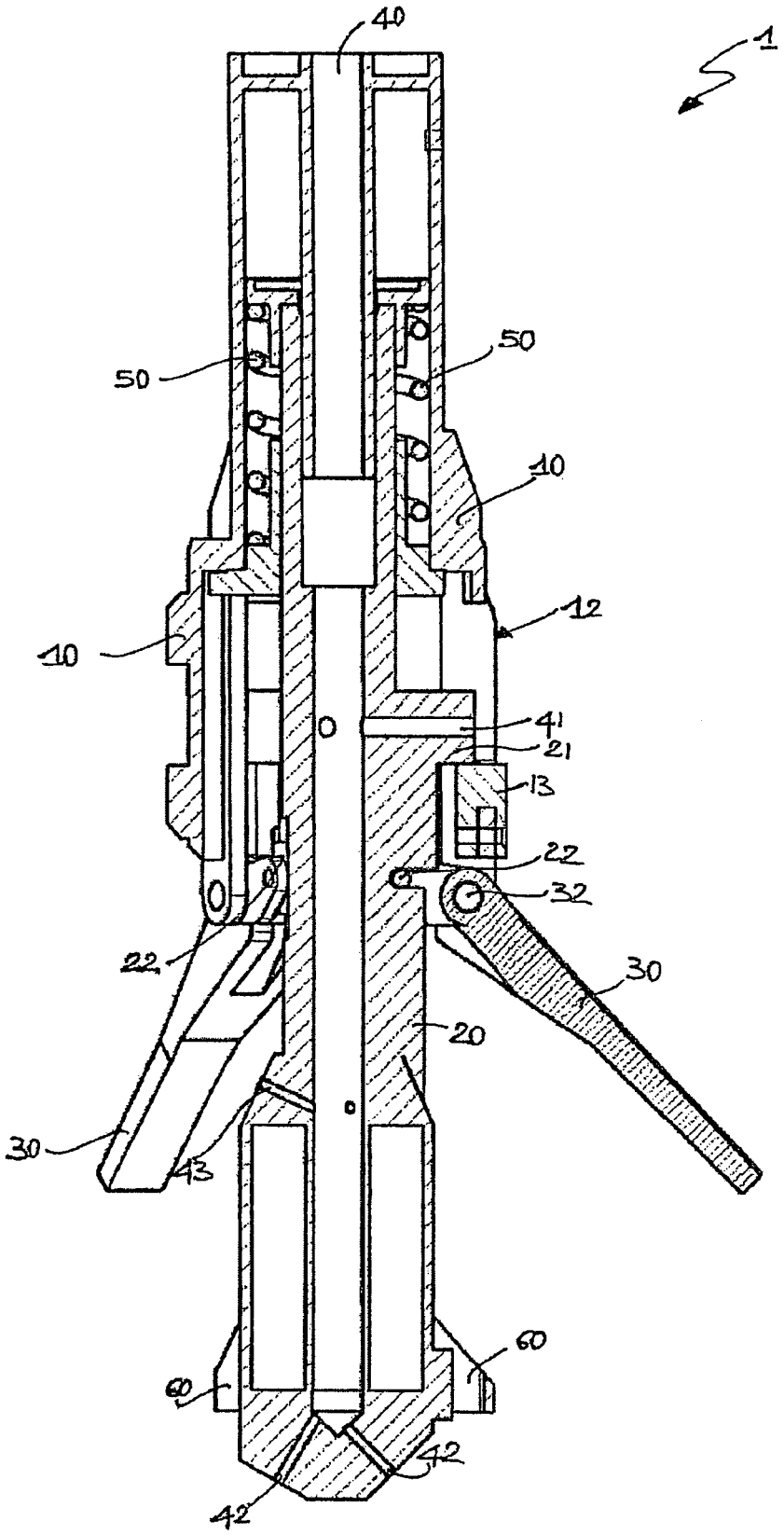
FIG. 4 illustrates a cross section of the device of FIG. 3.

In detail, illustrated respectively in FIGS. 3 and 4 are a three-dimensional view and a cross-sectional view of the device 1, where the mechanical contrast elements 23 that come to bear upon the respective arrests 13 may be noted. It may moreover be noted how, according to the requirements, the blades 30 can also block at a maximum opening angle smaller than 90° if measured with respect to the part of the device 1 that is first introduced, in use, into the soil or even at an angle greater than 90°.

In detail, during the operation of consolidation, i.e., with the blades 30 open (second position of use), in addition to the action of opening caused by the pressure of the mixing fluid on the central structure 20, there is also a further blocking force. This is constituted by the components of friction generated by the transmission of torque due to rotation between the body 10 and the central structure 20; the torque in fact is transmitted by the surfaces of the guides 12 to the lateral areas 21. Consequently, any external action that tends to displace the central structure 20 generates an opposite force of friction between the guides 12 and the lateral blocks 21, which prevents any movement of the blades 30.

By then blocking the central structure 20, there is obtained a blocking of a mechanical type also of the blades 30 by means of the pin 31 engaged in the respective cam 22.

When an upward motion is imparted, the device 1 starts the treatment of mechanical mixing, and the mixing fluid comes out of the first, second, and third terminations 41-43. An appropriate valve means (not represented), by closing the passages to the terminations 42 if subjected to mixing fluids (at a higher pressure), can possibly prevent the fluid itself from coming out from beneath, concentrating the disgregating action in just the lateral direction in the proximity of the blades 30.

Once then the depth of end of treatment of consolidation has been reached (which, according to the particular cases, may or may not coincide with the top surface of the soil), delivery of the mixing fluid is suspended, and the contrast spring 50 recalls the central structure 20 back into the body 10 of the device 1 so as to close the blades 30, which are then blocked by the plurality of pockets 60.

Even though there has so far been described a step of mixing upwards, in actual fact the step of mixing in which the blades 30 are open and of injection of the mixing fluid can be performed also downwards. In the latter case, unlike what has been described previously, the depth at which the blades 30 close after mixing will be that of the maximum depth desired or else that of return to the height of start-of-mixing.

In particular, in the case where mixing of the soil is carried out working downwards, the arrangement of the blades 30, which, when they are open, have a free end, distant from the body 10, that faces the soil, creates, during the operation of mixing, a force, opposite to the motion of drilling that aids the blades 30 themselves to be kept opened out. This can prove particularly useful when working on difficult soils.

The device 1 can moreover be modified in order to obtain a concave configuration of the blades 30 also when they come back up, in this case positioning hinging of the blades 30 in an area of the body 10 lower than the central structure 20 and reversing the arrangement both of the cams 22 and of the pin 31.

Finally, the device is equipped with a sensing instrumentation (not illustrated) for measuring the distance between the body 10 and the central structure 20 and/or for measuring the level of opening-out of the blades 30 and, consequently, the effective diameter of consolidation. In fact, if the length of the blades 30 is known beforehand, for example by measuring the relative displacement between the body 10 and the central structure 20 or, alternatively, the angle of opening of the blades 30, it is possible to arrive, with a fairly close precision, at the diameter within which they are working.

The above type of instrumentation can comprise linear or angular position sensors with actuation of an electrohydraulic type or of some other type and appropriate systems of display or representation of data.

As regards, instead, the transmission of the data from the position sensor to the system for display or representation of data, signal cables or data-transmission techniques of a wireless type can be used.

Figure 5:
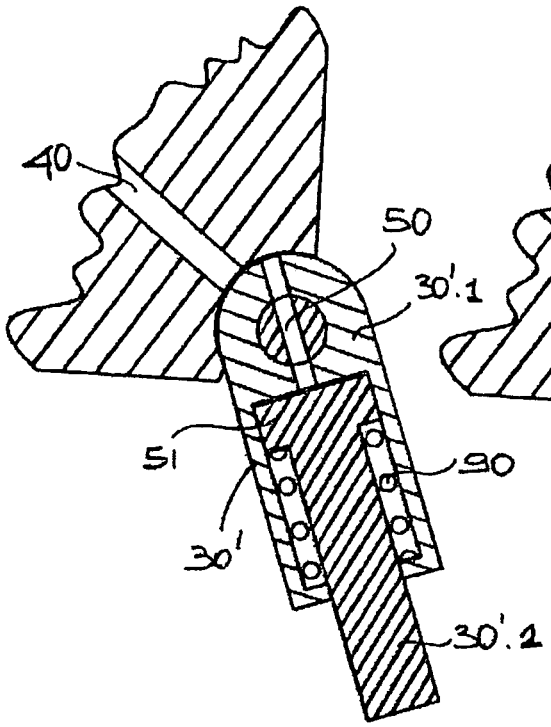
FIGS. 5 and 6 illustrate a first alternative embodiment of a part of the device of FIG. 1.
Figure 6:
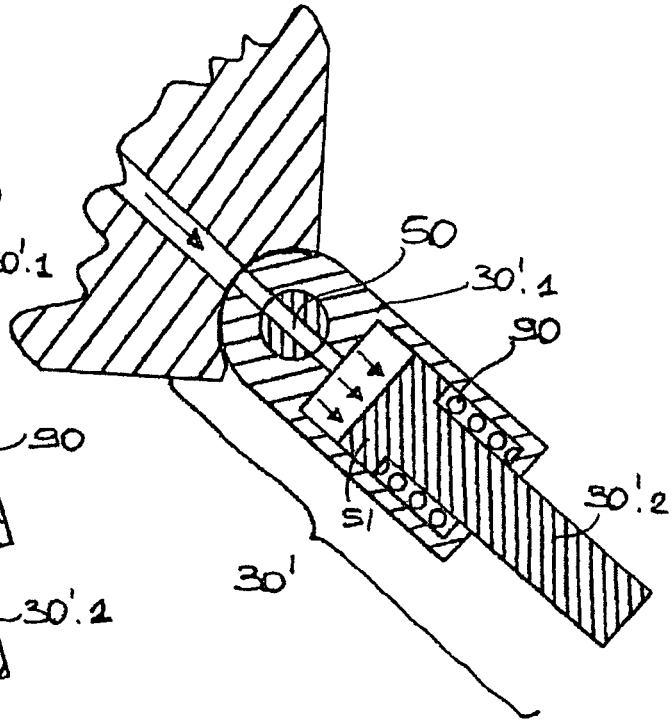

FIGS. 5 and 6 illustrate a first alternative embodiment of the blades 30' of the device so far described.

In detail, the blades 30' are of a telescopic type, designed to extend outwards in such a way as to achieve even larger mixing diameters, without increasing the longitudinal dimension of the device excessively. Furthermore, there is obtained a mixing diameter that increases gradually, and hence reactions on the pins that are less severe during mixing performed in the outermost regions (corresponding to the larger diameters) in so far as the soil that is present in the more inward regions (corresponding to the smaller diameters) is already mixed and hence disgregated and thus opposes a much lower resistance.

In detail, the blades 30' comprise a first, inner, portion 30'.1, hinged to the body of the device, and a second, outer, portion 30'.2, which is partially englobed within the inner portion 30'.1.

Extension of the blades 30' is obtained by exploiting the same fluid that controls opening-out thereof and in particular via chambers 50 that are set in communication with the conduit 40 only at a given stage of opening of the blades 30' themselves, thus enabling passage of the pressurized fluid, which comes to act upon a head 51 of the second portion 30'.2, as indicated by the arrows of FIG. 6. The head 51 acts in turn upon a spring 90 designed to keep the blades 30' in a retracted (and non-extended) position in conditions of absence of pressure of the fluid.

In detail, the spring 90, of a helical type, is positioned in the outermost section of the first portion 30'.1 of the blade 30' and is compressed when the pressure in the chamber 50 increases.

Alternatively, the blades 30' can be extended also via a pressure command governed by a dedicated valve (arrangement not represented).

Figure 7:
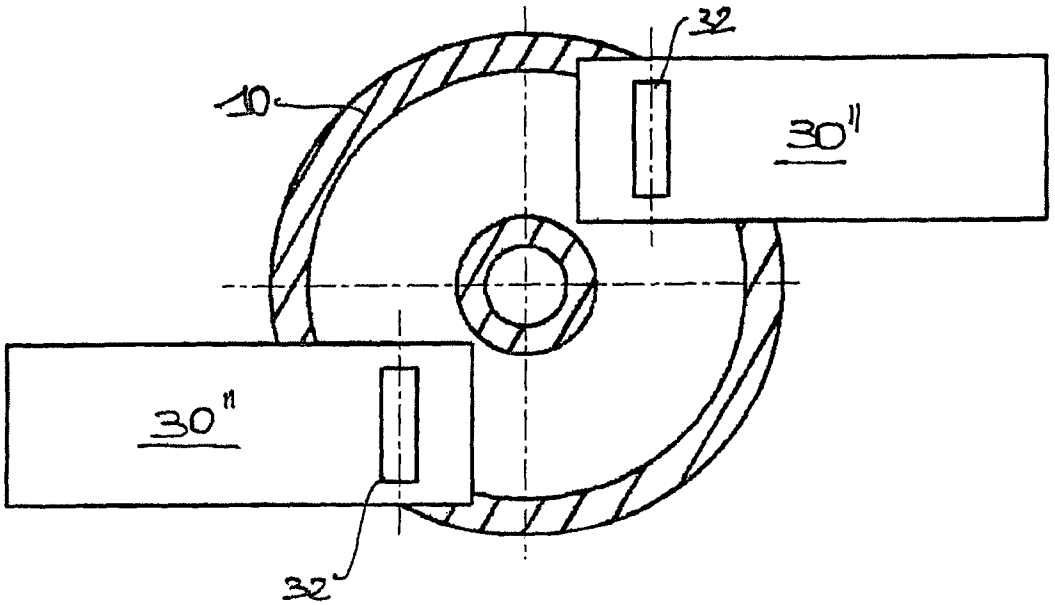
FIG. 7 illustrates a second alternative embodiment of a part of the device of FIG. 1.

Finally, FIG. 7 illustrates a second alternative embodiment of the blades 30", wherein the axes of rotation (axes of hinging 32) are set in a direction non-tangential to the transverse diameter of the tool, in any case enabling extension of the blades 30 to the largest diameter.

The advantages of the present invention emerge clearly from the foregoing description. In detail, the device 1 enables combination in a single tool of a device for widening bore holes, which is able to operate both upwards and downwards, with means for delivery of mixing fluid. The device can be actuated with rather simple mechanical means, and opening-out of the blades 30 is brought about for the most part (apart from possible forces generated in the drilling direction) by the pressure of the liquid injected in the internal conduit 40. Consequently, to change the operative configuration of the device 1 it is sufficient to vary the pressure of the fluid introduced into said conduit, without installing particularly complicated or costly instrumentation; it is sufficient, for example, to provide a pump that is able to develop different ranges of pressure. Consequently, it is possible to operate also with drilling fluids, keeping the blades closed and drilling at the smaller diameter, with consequent saving of energy and time.

In this way, also the structure of the drilling rods can be considerably improved in so far as it is no longer necessary to:

- have two dedicated delivery heads, one of which designed exclusively for delivery of fluids and the other dedicated to actuation of the blades; or
- have double-pass rods, with consequent reduction both in the difficulty of construction thereof and in the weights of the equipment to be moved.

Finally, the equipment is further simplified by the lack of actuator devices dedicated to opening or closing the blades 30, such as jacks, motors, or indexers; operation is obtained simply by exploiting the force generated by the pressure of a fluid.

Certain variations can be applied to the device so far described. In detail, the number of blades to be installed on the device can vary with respect to what has been represented, as likewise the shape thereof may vary.

In the first place, the number of blades of the device so far described can vary with respect to the one represented in the figures, which are consequently to be considered as representing purely non-limiting examples of a preferred embodiment of the device.

Alternatively, it is possible to use a single blade hinged at the centre so as to generate self-balancing loads of reaction.

Furthermore, in the bottom part of the device 1 there may be present a pointed chisel of a shape such as to aid drilling, for example, in particularly hard soils.

It is clear that the relative motion between the central body 20 and the external body 10 can be obtained by acting either upon the former (as described) or upon the latter (i.e., keeping the central body 20 stationary).

The invention claimed is:

1. A device for consolidating soils by mechanical mixing and injection of consolidating fluids, configured for being connected to one or more drilling rods and to carry out operations of drilling and mixing; the device comprising:

a main external body;

one or more blades pivotable with respect to said main external body, constrained by a plurality of pockets to a central structure internal to said main external body;

means for flowing drilling fluids and mixing fluids, connected in a liquid-tight way to at least one termination;

wherein a relative motion is generated between said central structure and said main external body as a function of the pressure of a liquid introduced into the means for flowing fluid, which brings about opening of said blades;

wherein a plurality of cams is provided on a support of the internal structure, each of said cams engaging a respective pin fixed with respect to the corresponding blade to generate movement of said blades with respect to said main external body.

2. The device according to claim 1, wherein a mixing fluid can be introduced within said means for flowing fluids both during a first step of descent in depth and during a second step of ascent towards the surface.

3. The device according to claim 1, wherein said blades have a respective supporting pin set in a non-tangential direction to a transverse diameter of the device.

4. A device for consolidating soils by mechanical mixing and injection of consolidating fluids, configured for being connected to one or more drilling rods and to carry out operations of drilling and mixing; the device comprising:

a main external body;

one or more blades pivotable with respect to said main external body, constrained by a plurality of pockets to a central structure internal to said main external body;

means for flowing drilling fluids and mixing fluids, connected in a liquid-tight way to at least one termination;

wherein a relative motion is generated between said central structure and said main external body as a function of the pressure of a liquid introduced into the means for flowing fluid, which brings about opening of said blades;

wherein said central body is connected to contrast means for countering the pressure of the liquid introduced into the means for flowing fluids; said contrast means being defined by:

a first operative condition, wherein the pressure of the liquid is within a first range and wherein the contrast means keep said central body retracted towards the contrast means and keep said blades in a first position of use, wherein the blades are substantially set in a direction of maximum extension of the device;

a second operative condition, wherein the pressure of the liquid is within a second range having a mean value significantly higher than that of the first range, wherein said pressure of the liquid pushes said central body towards the outside of the device and sets said blades in a second position of use, wherein said blades extend beyond the volume substantially identified by the body of the device delineating a drilling diameter that is larger than a diameter corresponding to the first position of use.

5. The device according to claim 4, wherein said contrast means comprise a load-adjustable spring.

6. The device according to claim 5, wherein the pressure of the liquid in said first range, exerted on said central structure, determines a force substantially smaller than the opposite force exerted at least in part by said contrast means; and wherein the pressure of the liquid in said second range exerted on said central structure develops a force substantially higher than the opposite force exerted at least in part by said contrast means.

7. The device according to claim 4, wherein said central body, in said second operative condition, slides until the central body reaches a maximum travel determined by the striking of mechanical contrast elements against a plurality of arrests, which have lateral areas configured to slide in one or more guides of the body.

8. The device according to claim 7, wherein said guides, during a rotation of said device, provide a secondary means for blocking said blades via friction generated by a torque transmitted by a surface of the guides to lateral areas.

9. The device according to claim 4, wherein fixed to said central structure is the plurality of pockets for the blades, which are configured to achieve a fixing at a distance from the ends of the blades constrained to the body when said blades are set in said first position of use.

10. The device according to claim 9, wherein:

said pockets are open in such a way as to facilitate exit of any material that may accumulate inside the pockets during the drilling or mixing operations; and said central structure has a travel having a first stretch of idle extension in which the blades can move with respect to the pockets, disengaging, and in which the partial superposition between the blades and the pockets occurs in a last step of closing of the blades.

11. A device for consolidating soils by mechanical mixing and injection of consolidating fluids, configured for being connected to one or more drilling rods and to carry out operations of drilling and mixing;

the device comprising:

a main external body;

one or more blades pivotable with respect to said main external body, constrained by a plurality of pockets to a central structure internal to said main external body;

means for flowing drilling fluids and mixing fluids, connected in a liquid-tight way to at least one termination;

sensing instrumentation for measuring mutual travel between the body and the central structure and/or measuring a level of opening-out of the blades; said instrumentation comprising linear or angular position sensors and a system for display or representation of data;

wherein a relative motion is generated between said central structure and said main external body as a function of the pressure of a liquid introduced into the means for flowing fluid, which brings about opening of said blades.

12. A device for consolidating soils by mechanical mixing and injection of consolidating fluids, configured for being connected to one or more drilling rods and to carry out operations of drilling and mixing; the device comprising:

a main external body;

one or more blades pivotable with respect to said main external body, constrained by a plurality of pockets to a central structure internal to said main external body;

means for flowing drilling fluids and mixing fluids, connected in a liquid-tight way to at least one termination;

wherein a relative motion is generated between said central structure and said main external body as a function of the pressure of a liquid introduced into the means for flowing fluid, which brings about opening of said blades;

wherein said termination forms part of a plurality of terminations comprising a first series of terminations and a second series of terminations, wherein at least part of said first series of terminations is oriented to direct a jet of liquid in a direction where said blades are lapped, and wherein at least one termination of said second series of terminations is oriented downwards in the proximity of said pockets and can be closed by means for interrupting flow.

13. A device for consolidating soils by mechanical mixing and injection of consolidating fluids, configured for being connected to one or more drilling rods and to carry out operations of drilling and mixing; the device comprising:

a main external body;

one or more blades pivotable with respect to said main external body, constrained by a plurality of pockets to a central structure internal to said main external body;

means for flowing drilling fluids and mixing fluids, connected in a liquid-tight way to at least one termination;

wherein a relative motion is generated between said central structure and said main external body as a function of the pressure of a liquid introduced into the means for flowing fluid, which brings about opening of said blades;

wherein said blades are telescopic and each have contrast means configured to exert a force opposing the extension of said blades.

* * * * *